US007077293B2

(12) United States Patent
McCann et al.

(10) Patent No.: US 7,077,293 B2
(45) Date of Patent: Jul. 18, 2006

(54) DRINK DISPENSING SYSTEM

(75) Inventors: Gerald P. McCann, Los Angeles, CA (US); Donald J. Verley, Lake Hughes, CA (US)

(73) Assignee: McCann's Engineering & Mfg. Co., Los Angeles, CA (US)

( * ) Notice: Subject to any disclaimer, the term of this patent is extended or adjusted under 35 U.S.C. 154(b) by 249 days.

(21) Appl. No.: 10/622,133

(22) Filed: Jul. 17, 2003

(65) Prior Publication Data

US 2005/0011910 A1 Jan. 20, 2005

(51) Int. Cl.
*B67D 5/56* (2006.01)

(52) U.S. Cl. ..... 222/129.1; 222/146.6; 222/318

(58) Field of Classification Search ..... 222/129.1, 222/146.6, 318, 424
See application file for complete search history.

(56) References Cited

U.S. PATENT DOCUMENTS

| | | | | |
|---|---|---|---|---|
| 3,011,681 A | | 12/1961 | Kromer | 222/1 |
| 3,162,323 A | | 12/1964 | Kromer | 222/1 |
| 3,215,312 A | | 11/1965 | Guzzi | 222/129.1 |
| 3,731,845 A | | 5/1973 | Booth | 222/67 |
| 3,813,010 A | | 5/1974 | Hassell et al. | 222/129.1 |
| 3,863,810 A | | 2/1975 | Hansen | 222/129.1 |
| 4,139,123 A | * | 2/1979 | Castillo | 222/56 |
| 4,148,334 A | | 4/1979 | Richards | 137/389 |
| 4,304,736 A | | 12/1981 | McMillin et al. | 261/35 |
| 4,333,587 A | | 6/1982 | Fessler et al. | 222/129.1 |
| 4,651,538 A | | 3/1987 | Bull et al. | 62/398 |
| 4,742,939 A | | 5/1988 | Galockin | 222/68 |
| 4,793,515 A | | 12/1988 | Shannon et al. | 222/69 |
| 4,850,269 A | | 7/1989 | Hancock et al. | 99/323.1 |
| 4,928,854 A | | 5/1990 | McCann et al. | 222/129.1 |
| 4,979,647 A | | 12/1990 | Hassell | 222/146.6 |
| 5,056,686 A | | 10/1991 | Jarrett | 222/129.2 |

(Continued)

FOREIGN PATENT DOCUMENTS

DE 23087 46 A 9/1974

(Continued)

OTHER PUBLICATIONS

U.S. App. No. 10/237,165, filed Sep. 6, 2002.

(Continued)

*Primary Examiner*—Joseph A. Kaufman
(74) *Attorney, Agent, or Firm*—Connolly Bove Lodge & Hutz LLP

(57) ABSTRACT

A drink dispensing system for at least one dispenser valve. The system includes a carbonator, an ice storage bin having heat transfer coils therein, a two-position valve, a carbonated water circuit, a source of water and a pump circuit. The two-position control valve acts in a first position to charge the carbonated tank with the source of water through a pump in the pump circuit. In a second position, the valve directs circulating flow through a closed loop carbonated water circuit which employs coils before and after the dispenser valves. A bypass around the pump allows flow at all times to the dispenser valves from the carbonator without passing through the pump. A shunt divides the output of the pump such that circulation is at about 15 gallons per hour even with the pump running at 100 gallons per hour. The shunt is not coupled with the pump with the control valve in the charge position. The pump may be a two-speed pump with the higher speed employed when the control valve is in the charge position. The system also may be employed with a single-speed pump.

19 Claims, 3 Drawing Sheets

U.S. PATENT DOCUMENTS

| | | | | |
|---|---|---|---|---|
| 5,353,958 | A * | 10/1994 | Hawkins | 222/54 |
| 5,413,742 | A | 5/1995 | Gatter | 261/140.1 |
| 5,419,393 | A | 5/1995 | Guy, III | 165/168 |
| 5,484,015 | A | 1/1996 | Keyes | 165/168 |
| 5,765,726 | A | 6/1998 | Jones | 222/129.1 |
| 5,839,291 | A | 11/1998 | Chang | 62/126 |
| 5,855,296 | A | 1/1999 | McCann et al. | 222/61 |
| 5,948,461 | A | 9/1999 | Miller | 426/565 |
| 5,996,842 | A | 12/1999 | Riley et al. | 222/1 |
| 6,021,922 | A | 2/2000 | Bilskie et al. | 222/67 |
| 6,068,875 | A | 5/2000 | Miller et al. | 426/565 |
| 6,196,418 | B1 | 3/2001 | McCann et al. | 239/249 |
| 6,196,422 | B1 * | 3/2001 | Tuyls et al. | 222/129.1 |
| 6,343,481 | B1 | 2/2002 | Simmons et al. | 62/298 |
| 6,394,311 | B1 | 5/2002 | McCann et al. | 222/61 |
| 6,401,981 | B1 | 6/2002 | McCann et al. | 222/129.1 |
| 6,505,758 | B1 | 1/2003 | Black et al. | 222/146.6 |
| 6,560,972 | B1 | 5/2003 | Ubidia | 62/59 |
| 6,725,687 | B1 | 4/2004 | McCann et al. | 62/389 |
| 2002/0005413 | A1 | 1/2002 | Black et al. | 222/146.6 |
| 2003/0066306 | A1 | 4/2003 | Renken et al. | 62/390 |

FOREIGN PATENT DOCUMENTS

| | | |
|---|---|---|
| EP | 0 307 150 A1 | 3/1989 |

OTHER PUBLICATIONS

McCann's Price List Mar. 1999.
Servend Brochure Feb. 2001.

* cited by examiner

DRINK DISPENSING SYSTEM

BACKGROUND OF THE INVENTION

The field of the present invention is systems for dispensing carbonated beverages and the cooling of the supplied beverages.

Commercial establishments with drink dispensing systems employ a variety of mechanisms to create and dispense carbonated and noncarbonated beverages. Such systems generally associated with what may be termed "fountain service" typically generate the carbonated water from carbon dioxide and service water. The beverage ingredients, water, carbonated water and syrups, are then mixed at faucets upon demand. Mixing spouts associated with valves forming the faucets are disclosed in U.S. Pat. No. 4,928,854 and U.S. Pat. No. 6,401,981, the disclosures of which are incorporated herein by reference. In commercial systems, the dispensers are conveniently located proximate to an ice storage bin. However, the ingredients are frequently stored at a distance from the dispensing equipment.

In bar service, as opposed to fountain service, bar gun systems are more frequently employed. Such guns include a long flexible sleeve with conduits therein. The conduits are full of various ingredients for supply on demand through valves to a spout. Because of limited space, fluids in these tubes have not been insulated. Bars employ a number of configurations from remote location of the supply to storage under the bar. Commonly, an ice bin is located near the bar gun as a further source of drink ingredients.

As an industry standard, it is preferred that the dispensing of beverages be at a lower temperature even though the beverages are typically poured over ice. This is particularly true of carbonated beverages where the amount of carbon dioxide which can be held by the liquid varies inversely with the temperature. The industry would like to keep carbonated water at the fountain to as close to 33° F. as possible and always below 40° F. Such systems conventionally use either a heat transfer system associated with the proximate ice storage bin or a mechanical refrigeration system for keeping the ingredients cold. Lines and tanks are frequently insulated to assist in keeping the chilled ingredients cold pending distribution.

In heat transfer systems, ice storage bins are provided with a cold plate forming the bottom of the bin. Coils are cast within the cold plate of the ice storage bins to effect heat transfer between ice within the bin and beverage ingredients flowing through the coils. Thus, certain of the various fluids combined to make beverages are chilled through these coils for distribution as beverage is drawn from the system. Beverage dispensing systems with a cold plate system now account for an estimated seventy to eighty-five percent of the fountain service dispensers used in the United States today. Bar gun systems also have employed cold plates in ice storage bins adjacent the dispenser for chilling carbonated water. A line from the cold plate extends to the gun parallel to syrup lines.

These cold plates can vary in size, depending on the desired number of soft drinks to be dispensed through a maximum use period and practical limitations such as space. The plates have many feet of stainless steel tubing formed in very tight coils that are cast inside a block of aluminum. The aluminum block provides a heat exchange container. High capacity cold plates can be from two to five inches thick and of various sizes depending on the size of the ice storage bin and the cooling requirements. Bar gun systems typically require smaller cold plates than in-store drink dispensing systems.

There are separate cooling paths for carbonated water, plain water and each flavor of syrup when all are cooled. The carbonated water heat transfer systems can employ a single or double coil circuit in series for cooling in high demand systems. The coils for carbonated water can be as long as seventy feet while the syrup coils are generally much less, often twenty to forty feet. Further, the tubing making up the syrup coils is frequently ¼" ID while the tubing for the carbonated coils is larger, from 5/16" to ⅜" ID. The tubing is tightly arranged within the cold plate with tight bends.

The length of tubing and the circuitous coiling of the tubing in such cold plates can create a significant pressure drop in the flow therethrough. The pressure drop can be of concern to designers where multiple sets of dispensers are used with passes through multiple coil circuits in series. An excessive pressure drop can adversely affect the operation of the system during busy times as a certain level of pressure is demanded at the dispensers to insure adequate throughput. The industry typically wants a minimum of 40 psi at the back of each faucet for carbonated water and a minimum of 15 psi for syrup. At the same time, excessive carbonation resulting from high pressure in the carbonator can create a foaming problem. Excessive pressure drop through successive coil circuits can, therefore, require substantial pressure prior to the cooling process to achieve the required minimum pressure at the faucet. If carbon dioxide is introduced prior to the pressure drop under such conditions, excessive carbonation can result.

Cold plates currently employed are disclosed in U.S. Pat. Nos. 4,651,538, 5,419,393 and 5,484,015, the disclosures of which are incorporated herein by reference. These cold plates are much heavier in design than earlier such devices. The cold plate systems have increased in size as greater and greater volumes of beverage are consumed. Typical soft drink serving volumes have grown from six ounces in the past to as much as sixty-four ounces today. Depending on the design, even greater pressure drops can be experienced.

The performance of such systems employing a cold plate naturally depends on the rate at which the beverages are being dispensed. So long as there is ice in the ice storage bin, adequate cooling is typically accomplished under high volume flow. However, during periods when there is low demand, the stagnated liquids between the cold plate and the dispensers or bar gun can experience a temperature rise, referred to in the industry as a casual drink warm-up, as there is no further contact with the cold plate.

A prior cold plate system avoiding the issue of over carbonation and excessive plate size employed a cold water system which circulated through a cold plate. Upon demand, cold water was delivered to an on-the-fly carbonator after leaving the cold water system and then to the faucet. The cooling system was, therefore, a source of cold water to the carbonated beverage dispensing system and did not operate within the dispensing system itself.

The mechanically refrigerated beverage dispensing systems are used to a lesser extent than cold plate units. Mechanical refrigeration is more expensive and requires more frequent service. The faucets of systems using such mechanical refrigeration are still typically mounted over an ice storage bin used for the drinks. Such ice storage is not used to cool the carbonated beverage and does not include a cold plate system when using mechanical refrigeration. Mechanical refrigeration systems typically circulate carbonated water to maintain an adequate reservoir of cooled supply. Even so, high volume flow can slowly tax the system with gradually increasing liquid temperatures with no recourse but to quit dispensing drinks rather than to just add more ice. When mechanical refrigeration systems fail, the system must be shut down pending repair rather than, again, just adding more ice.

Mechanically refrigerated cooling systems are principally employed with very high volume systems at substantial cost. Some disclosed systems are found in U.S. Pat. Nos. 3,011,681, 3,162,323, 3,215,312, 3,731,845, 3,813,010, 4,148,334, 4,304,736, 4,742,939 and 4,793,515, the disclosures of which are incorporated herein by reference.

Carbonated water is manufactured in stainless steel tanks varying in size from one quart to three or four gallons in commercial beverage dispensers. These tanks are generally pressurized at 60 to 110 psi by the carbon dioxide. The higher pressure requirements typically reflect higher water temperatures. Service water enters the tank as demanded. The level in the tank is controlled by a sensor and the supply is provided by an electric motor and pump assembly.

Systems can also employ water pressure boosters. Such boosters provide for a reservoir of pressurized water. They additionally may provide for a reservoir of carbonated water as well. Water pressure boosters can include a water chamber, a carbon dioxide pressurized or pressurized air chamber and a movable wall therebetween. The movable wall may be a bladder. The carbon dioxide pressurized chamber can also hold carbonated water with adequate liquid fill control. The boosters employ water pressure booster valves which respond to the amount of stored water in the water chambers. The valve directs water to the water chamber until a desired level is reached. Water is then directed to the carbonator. Both the booster and the carbonator can include switches to activate a supply pump for charging of the system. The booster and the carbonator functions accommodate a single supply pump and provide similarly pressurized carbonated and noncarbonated water to a beverage dispensing system. A booster combined with a carbonator is disclosed in U.S. Pat. Nos. 5,855,296 and 6,196,418, the disclosures of which are incorporated herein by reference.

In commercial systems, the carbonator is typically displaced from the dispensing system. The water is at ambient temperature and the carbon dioxide pressure is generally set at 90 psi to 100 psi. The volume of carbonation in the system is generally in the range of 5 to 6 volumes. As some carbonation is lost in the dispensing process, the initial level of carbonation before dispensing is typically higher than that in canned beverages. This overpressure accommodates the various conditions imposed by the dispensing system. However, the most problematic is the maintenance of low temperature within the beverage to be dispensed in order that stable carbonation can be maintained in the drink when dispensed. Extra pre-chillers and increased cooling coil footage have been employed to decrease the faucet temperature. Even so, the low volume casual drink usage remains problematic in cold plate systems.

Many drink dispensing systems currently in use throughout the country employ components the vast majority of which remain very useful. Such systems, using heat transfer cooling, employ dispenser valves, carbonators, ice storage bins and pumps. However, the systems are not capable of achieving temperatures for the carbonated water in the range of around 33° F. and below. Even so, there is a reluctance to give up useful components in order to achieve such advantageous cooling. Consequently, there is a need for apparatus capable of modifying current systems to employ useful existing components and achieve advantageous new features.

SUMMARY OF THE INVENTION

The present invention is directed to drink dispensing systems employing dispensers served by circulating fluid circuits. Ice storage bins having heat transfer coils therein are associated with a pump through a two-position control valve providing for system charging and circulation. The two-position control valve is provided with a first position coupling a source of water with the carbonator tank for recharging using the pump. In a second position, the control valve places the pump in the circulating carbonating water circuit with the capability of circulating carbonated water through heat transfer coils in an ice storage bin, and the carbonator with at least one dispenser valve in fluid communication with the circuit.

In a first separate aspect of the present invention, the carbonated water circuit includes a fluid shunt in the carbonated water circuit circumventing the two-position control valve. This shunt may be restricted or selectively restricted to reduce circulation flow through the carbonated water circuit. This provides the capability of employing a single pump for both charging the system and circulating carbonated water.

In a second separate aspect of the present invention, the carbonated water circuit is a closed loop independently of the two-position control valve. This may be accomplished through the use of a bypass about the control valve which may have a check valve to prevent unrestricted back flow to the pump.

In a third separate aspect of the present invention, the pump havs a two-speed pump drive with a first, higher speed employed during charging of the system and a second, lower speed employed for circulation of carbonated water. This feature improves efficiency of the system.

In a fourth separate aspect of the present invention, the dispenser valve is located between two heat transfer coils in the carbonated water circuit. This feature provides for the capability of supplying properly chilled water to the dispenser valves in both directions.

In a fifth separate aspect of the present invention, any of the foregoing separate aspects are contemplated to be employed in combination.

Accordingly, it is an object of the present invention to provide improved temperature maintenance in cold plate drink dispensing systems with the capability of employing a single pump. Other and further objects and advantages will appear hereinafter.

DETAILED DESCRIPTION OF THE PREFERRED EMBODIMENT

The novel features of the preferred embodiment are contemplated to be employable with, among others, the systems as disclosed in U.S. patent application Ser. No.

10/237,165, filed Sep. 6, 2002. The disclosure of this application is incorporated herein by reference.

Figure 3:
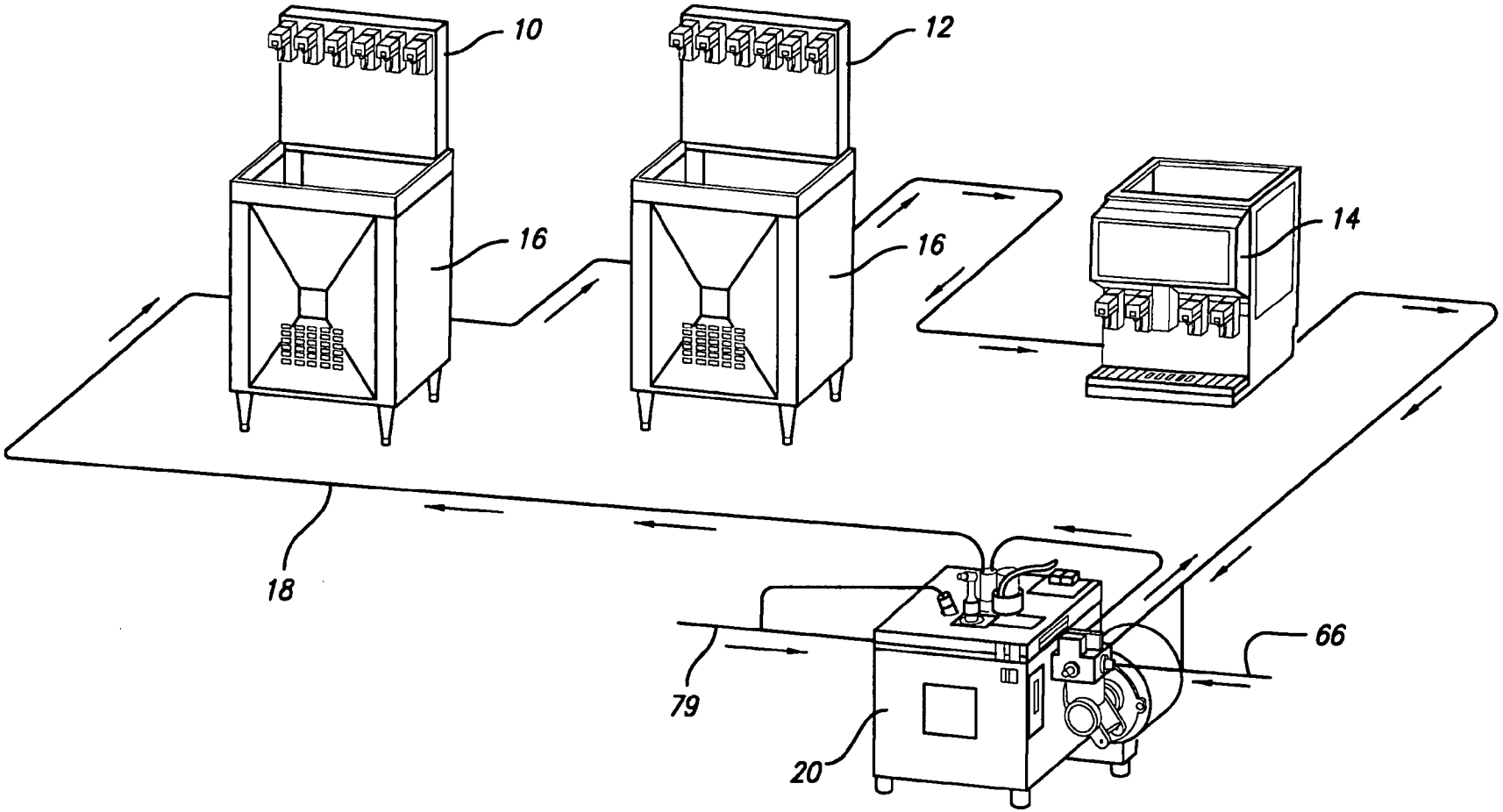
FIG. 3 is a schematic equipment layout for the dispensing system of FIGS. 1 and 2.

Turning in detail to the figures, FIG. 3 illustrates a drink dispensing system incorporating three sets of dispenser valves 10, 12 and 14. The sets of dispenser valves 10 and 12 are associated with ice storage bins 16. Flow of carbonated water is illustrated through the arrows associated with the circuit 18. An equipment box 20 controls supply and recirculation to the sets of dispenser valves 10, 12 and 14.

Figure 1:
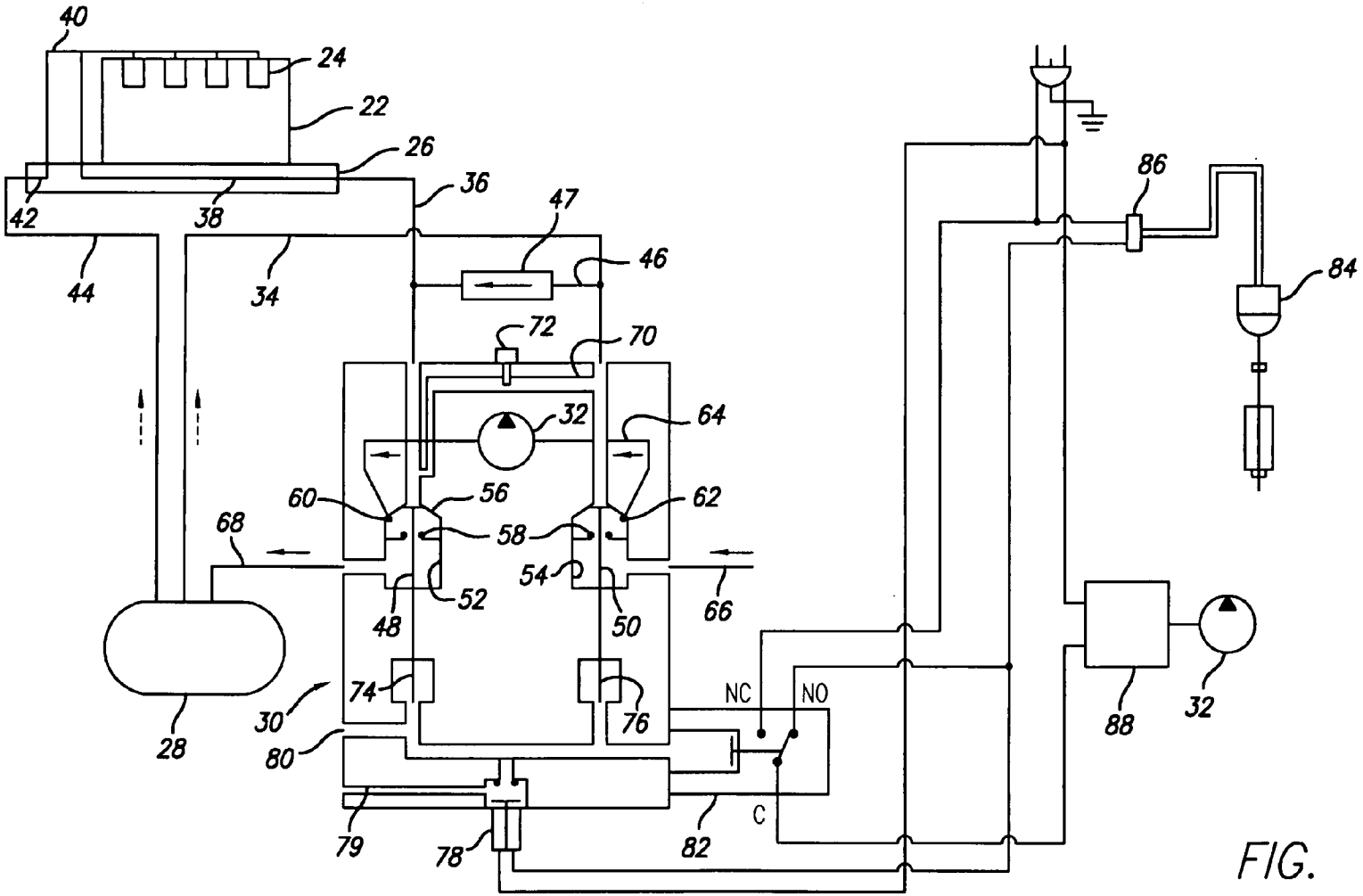
FIG. 1 is a schematic of a drink dispensing system in the charging mode.
Figure 2:
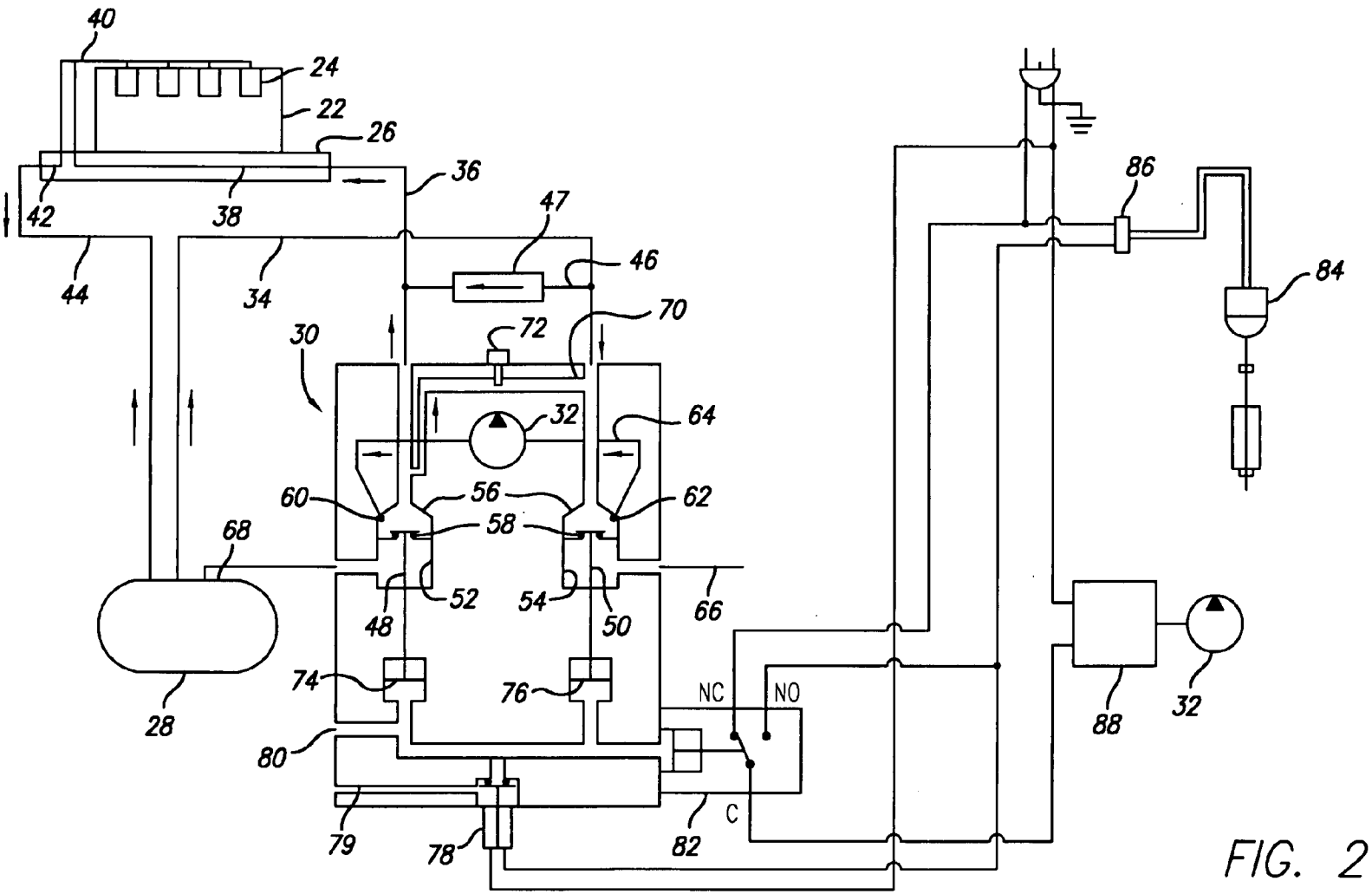
FIG. 2 is a schematic of the drink dispensing system of FIG. 1 in the circulation mode.

FIGS. 1 and 2 illustrate schematically the charging and circulation system. In FIG. 1, the system is in the charging mode; and in FIG. 2, the system is in the circulation mode. A dispenser 22 including dispenser valves 24 is shown schematically to be associated with a cold plate 26. The cold plate is typically placed within an ice storage bin such as illustrated in FIG. 3. The cold plate 26 would typically be found at the bottom of the ice storage bin with the ice piled thereon. The cold plate is typically an aluminum block with stainless steel tubes embedded therein. These tubes form heat transfer coils.

A carbonator tank 28 of conventional construction is employed with the charging and circulation system. A two-position control valve, generally designated 30, associated with a pump circuit including a pump 32, is also shown associated with the system. A carbonated water circuit defining a continuous loop includes a feed line 34 from the carbonator tank 28 to the two-position control valve 30. From the control valve 30, a supply line 36 extends to the cold plate 26. Heat transfer coils 38 in the cold plate 26 provide extended residence time and increased heat transfer area for the flow through the ice storage bins 16. A manifold 40 directs the chilled flow from the heat transfer coils 38 to the dispenser valves 24 for dispensing carbonated beverage. Further heat transfer coils 42 again provide an opportunity for cooling of fluid from the manifold 40 with which the dispenser valves are in fluid communication. A return line 44 is coupled with the carbonator tank 28 to complete the circuit.

To insure a closed loop independently of the two-position control valve 30, the carbonated water circuit further includes a bypass 46 extending around the two-position control valve 30 between the feed line 34 and the supply line 36. The bypass 46 includes a check valve 47 to allow free flow toward the dispenser valves 24 and prevent shunting of fluid therethrough back to the inlet of the pump 32 without passing through the full circuit. With the pump 32 out of the circuit, the carbonator tank 28 will continue to pressurize the carbonated water circuit such that dispensing through the dispenser valves 24 can take place. During charging, the pump 32 is not in communication with the carbonated water circuit so there is no forced circulation. However, demand from the dispenser valves 24 will be satisfied through the feed line 34 and the supply line 36 in one direction and/or the return line 44 in the other because of the differential pressure between the carbonator tank 28 and the open dispenser valve(s) 24.

Depending on the demand, the effective pump output when connected in the carbonated water circuit and the relative resistance between the various lines, flow from the carbonator tank 28 may occur either through the feed line 34 and the supply line 36 or through the return line 44 to the manifold 40. Through either path, the carbonated water will pass through one of the heat transfer coils 38 and the heat transfer coils 42. In this way, a properly chilled beverage will be supplied to the dispenser valves 24 substantially independently of the volume of demand, particularly with the ongoing circulation of carbonated water through the coils 38 and 42 pre-chilling the stored volume.

Looking more specifically to the two-position control valve 30, two valve elements 48 and 50 are located within valve cavities 52 and 54. The valve cavities 52 and 54 each have two valve seats 56 and 58. Pump access ports 60 and 62 provide the inlet and outlet to and from a pump circuit 64 which includes the pump 32. The valve seats 56 and 58 are to either side of the pump access ports 60 and 62 with the valve elements 48 and 50 traversing between seats to provide the two-position control. The circulation valve seats 56 are in fluid communication with the feed line 34 and the supply line 36. This access is closed with the control valve 30 in a first position. Also with the control valve 30 in the first position, fluid communication exists between the pump access ports 60 and 62 and a source of water line 66 and a charge line 68 to the carbonator tank 28.

With the two-position control valve 30 in a second position, the valve elements 48 and 50 are sealed against the charge valve seats 58. In this seconds position, the source of water line 66 and the charge line 68 are not in fluid communication with the pump 32. Rather, the feed line 34 and the supply line 36 are open to the pump access ports 60 and 62.

A shunt 70 extends in the body of the valve 30 between the feed line 34 and the supply line 36. In this position, the shunt 70 is effectively part of the carbonated water circuit as it is unaffected by operation of the valve 30. The shunt 70 includes a regulator 72 in the line such that selectable flow restriction may be applied. An appropriate regulator is disclosed in U.S. Pat. No. 5,097,863, the disclosure of which is incorporated herein by reference. The regulator is a flow control valve which maintains a selected and constant flow rate over a range of liquid delivery pressures. A setting is provided at the factory but can be fine tuned in the field if desired. The shunt 70 partially short circuits the pump 32 to insure that circulation through the carbonated water circuit will be driven by the pump 32 at about 15 gallons per hour. The pump 32 may actually provide output at approximately 100 gallons per hour with the shunt 70 taking 85 gallons per hour in the circulation mode if the pump 32 is driven at a single speed. The greater capacity is directly employed to charge the carbonator tank with the two-position control valve 30 in the first, charging position when the shunt 70 is not in fluid communication with the pump.

Control of the two-position control valve 30 is accomplished through two actuators 74 and 76. A solenoid 78 provides pressurized carbon dioxide 79 to the actuators 74 and 76 when energized. When the solenoid 78 is turned off, a valve is closed to the pressurized carbon dioxide and the actuators 74 and 76 are allowed to vent through vent passage 80. The actuators 74 and 76 may be diaphragms or conventional pistons. Springs (not shown) or resistance in diaphragms return the actuators 74 and 76 to the rest position. The passageways to the actuators 74 and 76 from the solenoid valve also energize a pressure actuated switch 82.

Actuation of the two-position control valve 30 is achieved through the circuit illustrated in FIGS. 1 and 2. The rest position for the valve 30 is in the second, circulation position. The probe 84 is located in the carbonator tank and senses the level of liquid in the tank. When the level is down, the probe switch 86 is closed to actuate the solenoid 78. This in turn actuates the switch 82 effectively indicating that the two-position control valve 30 is now in the first, charging position. With the pressure switch 82 actuated, the motor 88 driving the pump 32 is engaged at a higher speed. With the pressure switch deactivated, the motor 88 runs at a lower speed and effectively provides a two-speed pump drive. Alternatively, a singe speed pump drive can be employed albeit such a configuration will consume more power. Regardless of whether the pump 32 has a single speed or double speed pump drive, the shunt 70 is useful for tuning the rate of circulation flow through the carbonated water circuit.

In operation, a fully-charged and functioning system would have the solenoid valve 78 closed. In this condition, the valve elements 48 and 50 close off the source of water line 66 and the charge line 68 from the pump access ports 60 and 62. The pump is connected with the feed line 34 and the supply line 36 in the carbonated water circuit for circulation at about 15 gallons per hour with more or less flow through the shunt 70 depending on whether the pump 32 has a single or two-speed pump drive. When the dispenser valves 24 draw carbonated water, they are able to draw it from the supply line 36 and from the return line 34 as discussed above. Additionally, the pump 32 is preferably a positive displacement pump to insure appropriate flow regardless of the level of resistance in the lines within a reasonable range. If the demand from the dispenser valves 24 exceeds the supply by the pump 32, carbonated water is able to flow through the bypass 46 from the feed line 34 to the supply line 36 without passing through the pump 32 and the control valve 30. At the same time, flow to the manifold 40 may occur from the carbonator tank 28 through the return line 44. In all circumstances with the pump 32 driven by a single-speed drive, flow passes through the shunt 70 from the outlet of the pump to the inlet of the pump. Flow through the carbonated water circuit would be limited to the approximately 15 gallons per minute of circulation flow plus any additional flow demanded by the dispenser valves 24 above that circulation rate.

When the charge of carbonated water in the carbonator tank 28 drops below a preselected level, the probe 84 signals demand. The solenoid valve 78 is opened and the two-position control valve 30 is switched to the charge position coupling the source of water line 66 with the charge line 68 through the pump 32. At the same time, the feed line 34 and the supply line 36 are closed off from the pump. With a two-speed pump drive, the higher speed is selected. With a single-speed pump drive, all volume is directed from the source 66 to the charge line 68 as the shunt 70 is closed off with the feed line 34 and supply line 36. The rate of flow is contemplated to be about 100 gallons per minute.

Accordingly, an improved drink dispensing system has been disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A drink dispensing system comprising at least one dispenser valve;

a carbonator;

an ice storage bin including first heat transfer coils therein;

a two-position control valve including a first position and a second position;

a carbonated water circuit, the carbonator and the first heat transfer coils being in the carbonated water circuit and the dispenser valve being in fluid communication with the carbonated water circuit;

a source of water;

a pump circuit including a pump, an inlet and an outlet, the source of water being in communication with the inlet and the outlet being in communication with the carbonator with the two-position control valve in the first position and the carbonator being in communication with the inlet and the outlet being in communication with the carbonated water circuit with the two-position control valve in the second position.

2. The drink dispensing system of claim 1, the carbonated water circuit including a fluid shunt in the carbonated water circuit, the fluid shunt extending in fluid communication around the two-position control valve.

3. The drink dispensing system of claim 2, the fluid shunt having a flow control valve which maintains a selected and constant flow rate over a range of liquid delivery pressures.

4. The drink dispensing system of claim 2, the pump being a single speed pump.

5. The drink dispensing system of claim 1, the carbonated water circuit being a closed loop independently of the two-position control valve.

6. The drink dispensing system of claim 5, the carbonated water circuit including a bypass around the two-position control valve to close the loop of the carbonated water circuit around the two-position control valve.

7. The drink dispensing system of claim 6, the bypass having a check valve against backflow.

8. The drink dispensing system of claim 1, the pump having a two-speed pump drive with higher and lower speeds, the higher speed being engaged with the two-position control valve in the first position and the lower speed being engaged with the two-position valve in the second position.

9. A drink dispensing system comprising at least one dispenser valve;

a carbonator;

an ice storage bin including first heat transfer coils therein;

a two-position control valve including a first position and a second position;

a carbonated water circuit, the carbonator and the first heat transfer coils being in the carbonated water circuit and the dispenser valve being in fluid communication with the carbonated water circuit, the carbonated water circuit including a fluid shunt having selectable flow resistance, the fluid shunt extending in fluid communication around the two-position control valve and a bypass around the two-position control valve to close the loop of the carbonated water circuit around the two-position control valve;

a source of water;

a pump circuit including a pump, an inlet and an outlet, the source of water being in communication with the inlet and the outlet being in communication with the carbonator with the two-position control valve in the first position and the carbonator being in communication with the inlet and the outlet being in communication with the carbonated water circuit with the two-position control valve in the second position, the carbonated water circuit being a closed loop independently of the two-position control valve.

10. The drink dispensing system of claim 9, the bypass having a check valve against backflow.

11. The drink dispensing system of claim 9, the pump being a single speed pump.

12. The drink dispensing system of claim 9, the fluid shunt having a flow control valve which maintains a selected and constant flow rate over a range of liquid delivery pressures.

13. A drink dispensing system comprising at least one dispenser valve;

a carbonator;

an ice storage bin including first heat transfer coils and second heat transfer coils therein;

a source of water;

a pump;

a carbonated water circuit, the carbonator, the first heat transfer coils and the second heat transfer coils being in the carbonated water circuit, the dispenser valve being in fluid communication with the carbonated water circuit between the first heat transfer coils and the second heat transfer coils, the first heat transfer coils being in fluid communication between the carbonator and the dispenser valve in the carbonated water circuit and the second heat transfer coil being in fluid communication between the carbonator and the dispenser valve in the carbonated water circuit;

a control valve having a first position and a second position, the pump being in fluid communication between the source of water and the carbonator in the first position and the pump being in fluid communication between the carbonator and the carbonated water circuit in the second position.

14. The drink dispensing system of claim 13, the pump having a two-speed pump drive with higher and lower speeds, the higher speed selected with the control valve in the first position and the lower speed selected with the control valve in the second position.

15. The drink dispensing system of claim 13, the carbonated water circuit including a fluid shunt having selectable flow resistance, the fluid shunt extending in fluid communication around the two position control valve, the pump having a single speed.

16. The drink dispensing system of claim 15, the fluid shunt having a flow control valve which maintains a selected and constant flow rate over a range of liquid delivery pressures.

17. The drink dispensing system of claim 13, the carbonated water circuit being a closed loop independently of the two position control valve.

18. The drink dispensing system of claim 17, the carbonated water circuit including a bypass around the two position control valve to close the loop of the carbonated water circuit around the two position control valve.

19. The drink dispensing system of claim 18, the bypass having a check valve against backflow.

* * * * *